US006016932A

United States Patent [19]

Gaydosh et al.

[11] Patent Number: 6,016,932

[45] Date of Patent: Jan. 25, 2000

[54] HOT FILL CONTAINERS WITH IMPROVED TOP LOAD CAPABILITIES

[75] Inventors: Kevin D. Gaydosh, Adrian; Richard J. Steih, Britton; Michael T. Lane, Brooklyn, all of Mich.

[73] Assignee: Schmalbach-Lubeca AG, Ratingen, Germany

[21] Appl. No.: 09/180,316

[22] PCT Filed: Oct. 3, 1997

[86] PCT No.: PCT/US97/17806

§ 371 Date: Nov. 4, 1998

§ 102(e) Date: Nov. 4, 1998

[87] PCT Pub. No.: WO98/16435

PCT Pub. Date: Apr. 23, 1998

Related U.S. Application Data

[63] Continuation of application No. 08/729,864, Oct. 15, 1996, abandoned, which is a continuation-in-part of application No. 08/452,875, May 31, 1995, abandoned.

[51] Int. Cl.[7] ..... B65D 1/02

[52] U.S. Cl. ..... 215/382; 215/384; 220/675; 220/671

[58] Field of Search ..... 215/382, 383, 215/384, 40, 42; 220/669, 670, 671, 672, 673, 675, 755, 770, 771

[56] References Cited

U.S. PATENT DOCUMENTS

D. 316,968 5/1991 York .
D. 321,830 11/1991 York et al. .
3,317,110 5/1967 Palmer .
3,536,500 10/1970 Cleereman et al. .
4,024,975 5/1977 Uhlig .
4,805,788 2/1989 Akiho .
4,863,046 9/1989 Collette et al. .
4,993,565 2/1991 Ota et al. .
5,054,632 10/1991 Alberghini et al. .
5,067,622 11/1991 Garver et al. .
5,141,120 8/1992 Brown et al. .
5,178,289 1/1993 Krishnakumar et al. .
5,217,128 6/1993 Stenger ..... 215/370
5,224,614 7/1993 Bono et al. .
5,261,543 11/1993 Ugarelli .
5,337,909 8/1994 Vailliencourt .

*Primary Examiner*—Stephen Castellano
*Attorney, Agent, or Firm*—Harness, Dickey & Pierce, P.L.C.

[57] ABSTRACT

A blow molded, thin walled plastic container for filling with a liquid whose temperature is elevated above ambient. The container includes a first portion of a first diameter, a second portion of a second diameter, and reduced diameter region between the first and second portions. The reduced diameter portion extends circumferentially around the container and a plurality of ribs which are located to extend between the first and second portions. The ribs form reinforcing members in the reduced diameter portion and increase the top load capabilities of the container. The first and second portions can both be formed in the shoulder portion of the container or one in the shoulder portion and one in the sidewall of the container.

10 Claims, 3 Drawing Sheets

HOT FILL CONTAINERS WITH IMPROVED TOP LOAD CAPABILITIES

This application is a continuation of Ser. No. 08/729,864, filed Oct. 15, 1996, now abandoned, which is a continuation-in-part of Ser. No. 08/452,875 filed May 31, 1995, now abandoned.

BACKGROUND OF THE INVENTION

1. Field of the Invention

The present invention relates to thin walled containers for the storage of liquids. More particularly, this invention relates to blow molded, plastic containers capable of being filled with a liquid while the liquid is at a temperature elevated above the ambient temperature, configured to accommodate a partial vacuum formed within the container during cooling of the liquid after filling and capping, and configured to exhibit enhanced top load capabilities.

2. Description of the Prior Art

In the past, plastic containers have been used to contain liquids that were initially filled while chilled or at ambient temperatures. However, in recent years, plastic containers have been developed which can be used to contain liquids, such as processed fruit juices and the like, which are pasteurized and must be filled into the container while still hot and near pasteurized. Containers of this type are generally known as "hot-fill" containers and have become well known. Examples are shown in U.S. Pat. Nos. 4,805,788 and 4,863,046.

Hot-fill conditions impose mechanical stresses on the container structure which differ from those stresses imposed during non-hot-fill applications. These additional mechanical stresses cause the material forming the container to be less resistant to deformation when hot-filling both during and after. When subjected to the stresses of hot filing, conventional containers deform or collapse.

Additional concerns during hot-filling include a decrease in container rigidity, which occurs immediately after hot-filling, and reduced internal pressures which develop as the volume of the liquid in the container shrinks during cooling. Obviously, containers intended for hot-fill applications must be able to withstand both the initial decrease in rigidity and the subsequent decrease in internal pressures, while maintaining a desirable aesthetic appearance.

Various structural configurations and process methodologies have been developed to alleviate the above concerns. Most often, the material forming the container is heat treated or "heat set" to produce a container having better thermal stability. Heat setting of the container generally increases the crystallinity of the container, without adversely affecting the container appearance, and increases the strength and durability of the container. Additionally, hot-fill containers are generally provided with structural panels in the container side wall in order to fully accommodate volumetric shrinkages as the liquid cools. The vacuum panels themselves collapse or flex inwardly to accommodate the liquid as it shrinks in response to cooling. This inwardly flexing of the vacuum panels, however, creates additional undesirable stress points, particularly in the comers of the panels.

Containers of the above type have exhibited a limited ability to withstand top loading during filling, capping and stacking for transporting of the containers. Overcoming these problems is important because it would decrease the likelihood of a container's top or shoulder being crushed, as well as inhibiting ovalization in this area. Obviously, it is important to be able to stack containers so as to maximize the use of shipping space. It also enhances the ability to lightweight the container.

One way to eliminate the concerns related to the above mentioned stress points is to increase the thickness of the container's side wall. Such an increase also increases the material cost for the container and the weight of the container, both of which are unacceptable. Instead of increasing the side wall thickness, other solutions have included providing ribs extending along the edges of the panels, providing horizontal ribs in the panels themselves, providing smaller panels in multiple rows around the container, and by providing circumferential reinforcement ribs at the upper and lower edges of the panels. While all of the above methods have worked satisfactorily to some extent, none of these methods significantly increased the top loading capabilities.

As seen from the above discussion, the side wall of the container has been given considerable attention in the effort to control the mechanical stresses imposed on the container as a result of the hot-filling process. Little or no consideration has been given to the upper portion of the container, including the shoulder and waist regions of the container.

As mentioned above, a particular problem which can result from the hot-filling procedure is a decrease in the container's ability to withstand top loading during filling, capping and labeling. Because of the decreased container rigidity immediately after filling and after cooling, even heat set containers are less able to resist loads imparted through the top or upper portion of the container, such as when the containers are stacked one upon another for storage and shipping. Similar top loads are imparted to the container when it is dropped and lands on the upper portion or mouth of the container. As a result of this type of top loading, the container can become deformed and undesirable to the consumer.

In view of the foregoing limitations and shortcomings of the prior art containers, as well as other disadvantages not specifically mentioned above, it should be apparent that there exists a need for an improved hot-fill container having increased top loading capabilities.

Accordingly, it is an object of the present invention to fulfill that need by providing a hot-fill container having an increased top loading structural integrity.

It is also an object of this invention to provide a container having an upper portion which is reinforced by structural provisions that provide the container with an enhanced top loading capability.

Yet another object of the present invention is to provide a number of structural reinforcements in the waste region of the container to resist deformation of the container resulting from top loading.

SUMMARY OF THE INVENTION

Briefly described, the above and other objects are accomplished according to the present invention by providing a thin walled plastic container adapted to be filled with a liquid at a temperature elevated above room temperature. The container includes an upper portion, as waist region, a middle portion and a lower portion.

The upper portion forms the top of the container and further includes a mouth, a neck and what is herein referred to as a shoulder or bulb. The mouth defines an opening into the container through which the container is filled and emptied. Threads are formed on the exterior of the neck for receiving a closure cap and sealing the container. Extending downward from the neck and generally increasing in diameter relative to the neck, is the bulb, which may be of a single or double-bulb design.

Forming the body of the container, the middle portion defines the generally cylindrical side wall of the container. The shape of the side wall is such that it will accommodate the effects of a decrease in internal pressure within the container as the liquid cools.

The waist region is located between the upper and middle portions of the container and unitarily connects these two portions together. The lower portion closes and forms the bottom of the container. This portion is unitarily formed with a lower periphery of the side wall.

In one embodiment, upright ribs are formed in the waist region and extend between the upper and middle portions or, more specifically, the bulb and the side wall of the container. In another embodiment, upright ribs are formed in the upper portion of the container, between the bulbs of a double-bulb shoulder portion. The ribs provide structural reinforcement to the container and allow it to exhibit an increased top loading capacity. This in turn provides the container a greater ability to withstand filling, capping, labeling, stacking and impact loads applied to the top of the container.

Additional benefits and advantages of the present invention will become apparent to those skilled in the art to which the present invention relates from the subsequent description of the preferred embodiment and the appended claims, taken in conjunction with the accompanying drawings.

DETAILED DESCRIPTION OF THE PREFERRED EMBODIMENT

Figure 1:
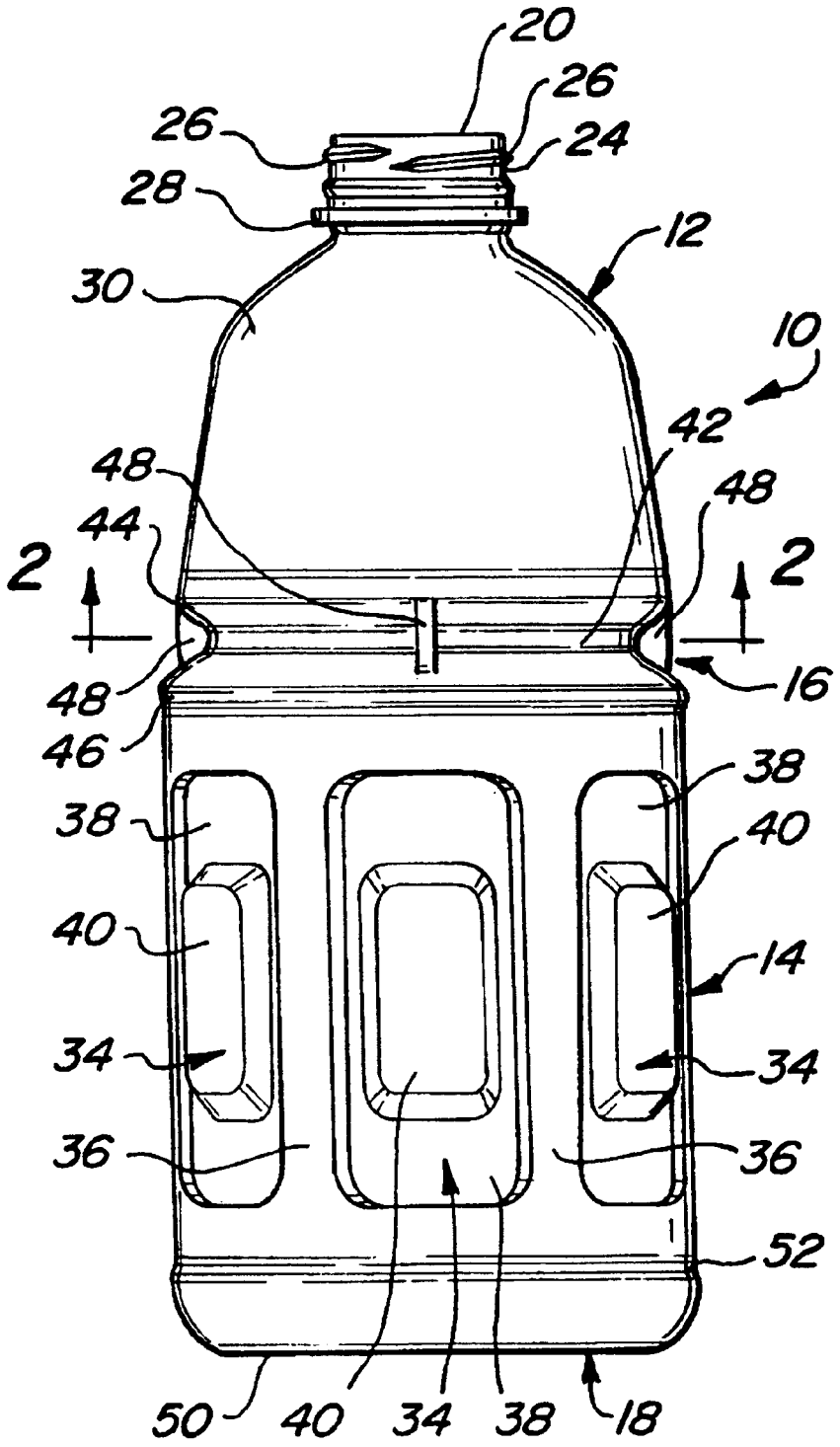
FIG. 1 is a side elevational view of a container embodying the principles of the present invention.

Referring now in detail to the drawings, there is shown in FIG. 1 a container, designated at 10, embodying the principles of the present invention. Generally, the container includes an upper portion 12, a middle portion 14, a waste region 16 and a bottom portion 18.

The container 10 is preferably formed by a blow molding process which imparts both axial and radial elongation and orientation into the plastic forming the container 10. Numerous different plastics can be used to form the container 10, including but not limited to the broad class of polyester, polyethylene terepthalate (PET) and polyethylene napthalate (PEN). Once formed, the container 10 is preferably heat set through a heat treating process to enhance the thermal stability of the container 10. Such heat treating methods are well known in the industry and are therefore not more fully disclosed herein.

The upper portion 12 includes a mouth 20 which defines an opening 22 into the interior of the container 10. Filling and emptying of the contents of the container 10 are both performed through this opening 22. Immediately adjacent to the mouth 20 is the neck 24. Threads 26 are formed, at least partially, around the outer circumference of the neck 24. The threads 26 are capable of receiving a corresponding threaded closure cap (not shown) which seals the container after filling. A radial flange 281, sometimes referred to as a finger ring, allows a person to support or carry the container 10 by positioning two fingers, one on each side of the neck 24, beneath the flange 28.

Immediately below the neck 24, the upper portion 12 transitions into one embodiment of what has herein been referred to as a shoulder, bulb or domed portion 30. The bulb 30 extends downward from the neck 24 and generally increases in diameter as it proceeds away from the neck 24. While shown having a domed configuration, the bulb 30 can be provided with numerous alternative configurations and need not be either "bulbed" or "domed". Alternative shapes for the bulb 30 should therefore be considered as being encompassed by the present invention.

The middle portion 14 of the container 10 defines a generally cylindrical side wall 32. Formed in the side wall 32 are a plurality of vacuum panels 34. The vacuum panels 34 are configured to accommodate the negative pressures which are generated within the container 10 as a result of the cooling of the hot-filled liquid. In the illustrated embodiment, the vacuum panels 34 are shown as generally rectangular panels being equidistantly spaced around the circumference of the side wall 32 and separated by substantially vertical ends 36.

The panels 34 themselves include a generally recessed first portion 38. In the middle of this first recessed portion 38 is a raised second or panel portion 40. While a specific configuration for the vacuum panels 34 is illustrated, it will be understood that the actual configuration of each vacuum panel 34 can vary from that illustrated and that the panels 34, if properly designed, need not be equidistantly spaced about the circumference of the side wall 32. Thus, the only requirement in this regard with respect to the present invention is that the container be capable of withstanding the resulting negative pressures from both a functional and aesthetic view point.

The lower portion 18 of the container 10 defines the bottom of the container and closes off this portion of the container 10. A bottom 50 is therefore unitarily formed with a lower periphery 52 of the side wall 32 in order to close off the bottom of the container 10.

As briefly mentioned above, the bulb 30 and the side wall 32 are unitarily formed with one another in what is referred to as the waste region 16. The waste region 16 can generally be described as a circumferential recess or annular groove 42 formed between the lower periphery of the bulb 30 and the upper periphery of the side wall 32. These lower and upper circumferential peripheries are each represented in FIGS. 1 and 2 as a slight ridge and are respectively designated at 44 and 46.

Extending generally upright or vertically between the upper and lower circumferential ridges 44 and 46 are a series of reinforcement webs or ribs 48. In the illustrated embodiment, four ribs 48 are shown and each of the ribs is equidistantly located about the circumference of the container 10 in the waste region 16. A greater number or lesser number of ribs 48 could alternatively be provided and it is anticipated, depending on the attributes of the specific container, that the ribs 48 need not to be equidistantly spaced about the container 10.

Figure 2:
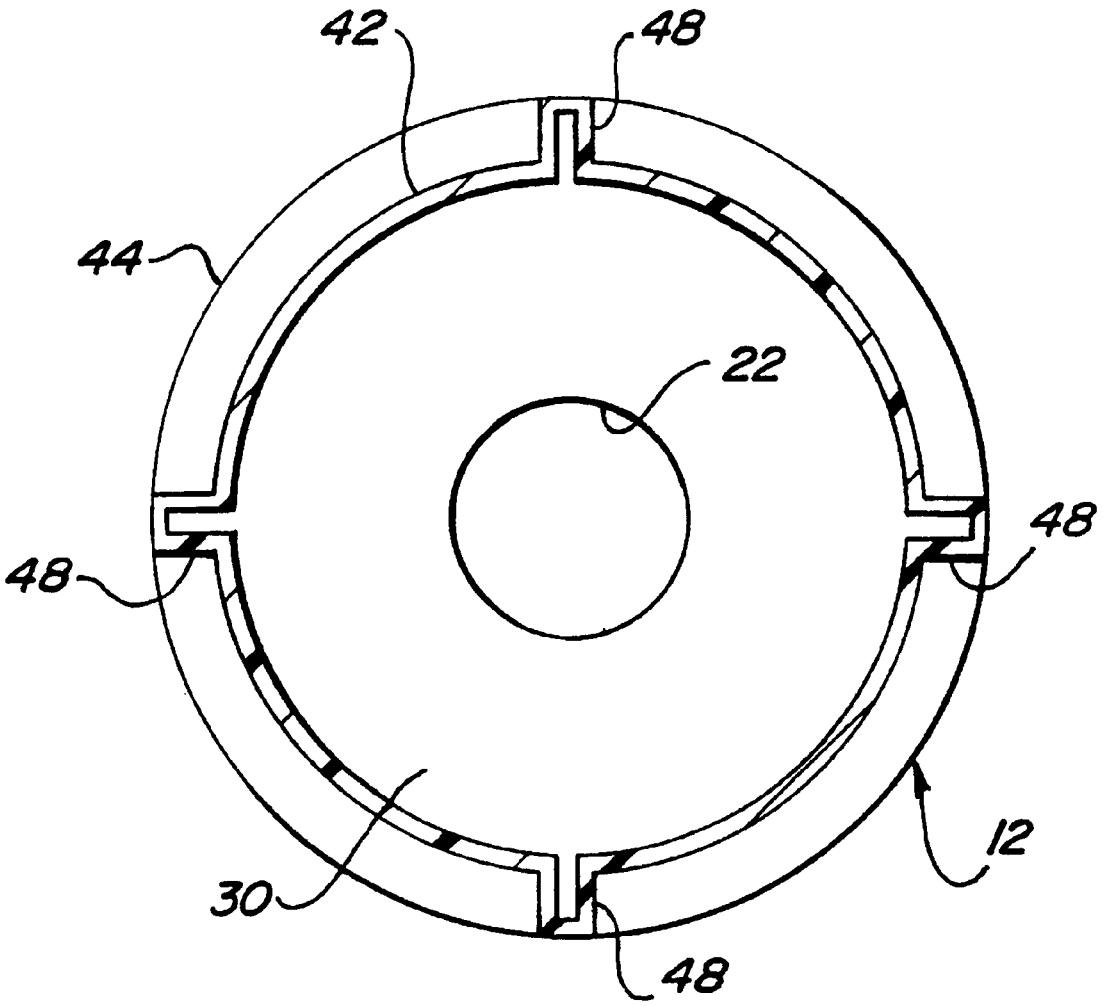
FIG. 2 is a cross sectional view taken substantially along line 2—2 in FIG. 1 further showing the waist ribs of the present invention.
Figure 3:
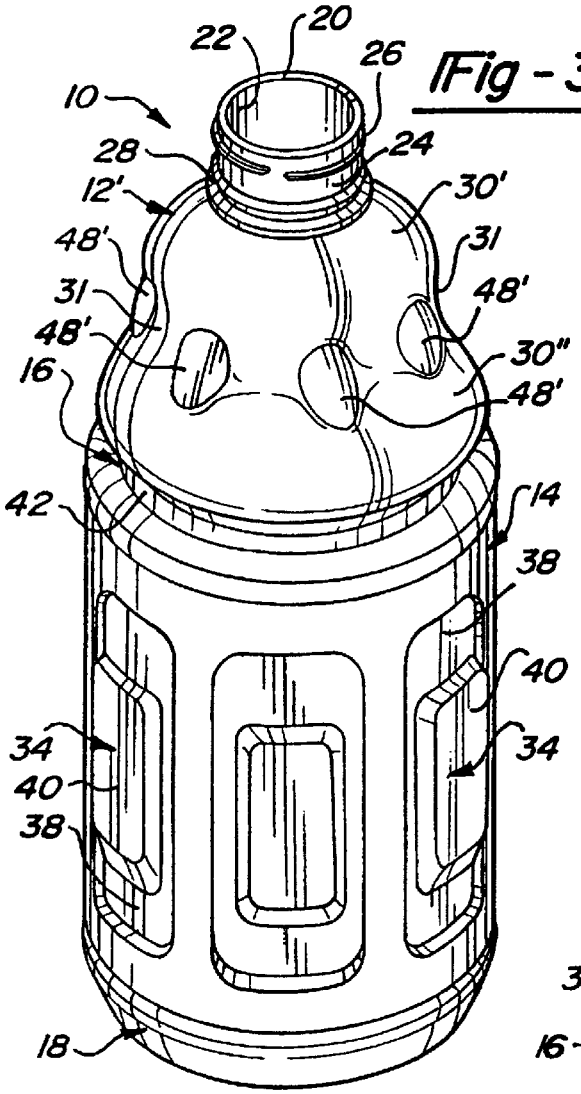
FIG. 3 is a perspective view of a container according to a second embodiment of the present invention.

The ribs 48 are shown in a construction which provides them as a hollow, generally U-shaped (in cross sectional shape) support between the upper and lower portions 12 and 14 of the container 10. As seen in FIG. 2, the ribs 48 are oriented such that the open portion of the U-shape is toward the interior of the container 10. It should be noted, however, that the ribs 48 need not be limited to the illustrated hollow construction, cross sectional shape or orientation. The ribs 48 could alternatively be provided as other structures with other shapes. For example, the ribs could be provided as solid structures and having a rectangular cross sectional shape.

FIGS. 3–6 illustrate a second embodiment of the present invention in which numerous features and elements are the same as those found in the previously discussed embodiment. For this reason, features common to both embodiments are designated with like item numbers and are not being further discussed.

Generally, the container 10' of the second embodiment differs from the container 10' of the first embodiment in the shape of the shoulder portion 12' and the location of the ribs 48'. In the second embodiment, the shoulder portion 12' is provided as a double-bulb portion with an upper bulb 30' and a lower bulb 30". The upper bulb 30' is located generally adjacent to the neck 24 of the container 10', while the lower bulb 30" is located adjacent to the waist region 16. A transition portion 31, having a reduced diameter relative to the upper and lower bulbs 30' and 30", unitarily interconnects the upper and lower bulbs 30' and 30". While illustrated and discussed as having a reduced diameter relative to the bulbs 30' and 30", it is believed possible for the transition portion 31 to have a diameter which approximates that of the upper bulb 30'. In any regard, the transition portion 31 generally forms and can be seen as a recessed annular groove between the upper bulb 30' and the lower bulb 30".

Figure 6:
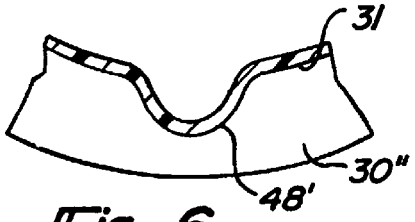
FIG. 6 is a partial sectional view through the container of FIG. 4 as generally taken along lines 6—6.
Figure 5:
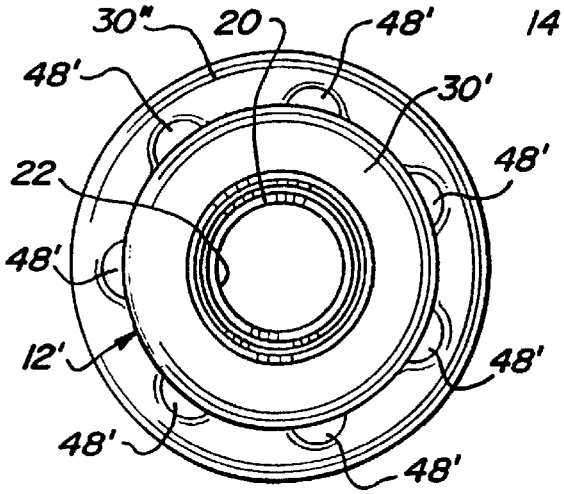
FIG. 5 is a top plan view of the container seen in FIGS. 3 and 4.
Figure 4:
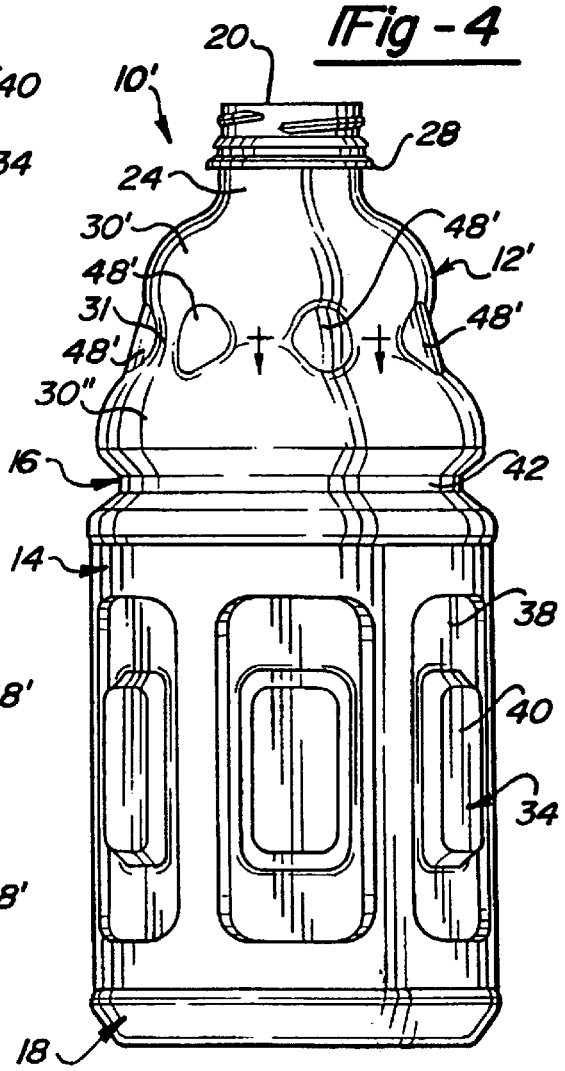
FIG. 4 is a side elevational view of the container seen in FIG. 3.

Located in the area of the transition portion 31 are a series of generally upright or vertical ribs 48'. The ribs 48' are hollow, as seen in FIG. 6, and extend longitudinally between the upper bulb 30' and the lower bulb 30" while protruding outward from the transition portion 31. As seen in FIG. 6, the ribs 48' are also generally U-shaped with their open end being directed toward the interior of the container 10'.

The ribs 48' are equidistantly located about the transition portion 31 of the container 10' and an odd number of ribs 48' are provided in the illustrated embodiment. Providing the ribs 48' in this manner results in no two ribs 48' being located in a common plane through the longitudinal axis of the container. This in turn decreases the likelihood that the upper portion 12' of the container 10' will "kink" or bend over as a result of a top load or impact load being applied to the container 10'. In the illustrated embodiment, seven ribs 48' are provided on the container 10' with more or less also being within the purview of the invention. While less preferred, the ribs 48' could alternatively be provided in an even number and positioned so that two opposing ribs would be located in a common plane through the longitudinal axis of the container 10'.

By orienting and positioning the ribs 48' as described between the upper and lower bulbs 30' and 30', the ribs 48' operate to reinforce the transitional portion 31 and increase this area's resistance to deformation from top loads. Accordingly, the top load capacity of the container 10' is increased. In addition to inhibiting "bending over" failure in the shoulder portion 12' of the container 10', the provision of the ribs 48' in this area inhibits ovalization of the transition portion 31 during the hot filling process itself. Obviously, this is an additional enhancement to the container.

While the above description constitutes the preferred embodiment of the present invention, it will be appreciated that the invention is susceptible to modification, variation and change without departing from the proper scope and fair meaning of the accompanying claims.

We claim:

1. A thin walled, blow molded, polyester container adapted to be filled with a liquid at a temperature elevated above room temperature, said container comprising:

a mouth defining an opening into said container;

a neck including sealing means formed at least partially thereon for receiving a closure cap to seal said container;

a shoulder portion adjacent to said neck and extending generally downward and outward therefrom;

a side wall of generally tubular shape, said side wall being configured to accommodate a volumetric shrinkage of the liquid as a result of cooling of the liquid;

a bottom portion closing off said side wall and forming a base of said container;

a upper portion extending downward from said neck and generally increasing to a first diameter proceeding away from said mouth;

a lower portion located between said upper portion and said bottom portion, said lower portion defining a second diameter;

a reduced diameter portion located between and unitarily connecting said upper portion with said lower portion, said reduced diameter portion extending circumferentially around said container and forming a recessed annular groove between said upper portion and said lower portion, said reduced diameter portion having a diameter which is less than said second diameter; and at least three substantially upright ribs formed in said reduced diameter portion, said ribs being located such that no two ribs are in a common plane drawn through a longitudinal axis through said container and being hollow and extending longitudinally between said upper portion and said lower portion, said ribs reinforcing said reduced diameter portion increasing the top load capacity of said container, said ribs being equidistantly spaced around said reduced diameter portion and protruding radially outward from said reduced diameter portion.

2. A thin walled, blow molded, polyester container as set forth in claim 1 wherein said upper portion is formed in said shoulder portion.

3. A thin walled, blow molded, polyester container as set forth in claim 2 wherein said lower portion is foreword in said shoulder portion.

4. A thin walled, blow molded, polyester container as set forth in claim 1 wherein said lower portion is a portion of said side wall.

5. A thin walled, blow molded, polyester container as set forth in claim 1 wherein said first diameter is greater than said second diameter.

6. A thin walled, blow molded, polyester container as set forth in claim 1 having an odd number of said ribs.

7. A thin walled, blow molded, polyester container as set forth in claim 1 wherein said ribs are generally U-shaped in horizontal cross section.

8. A thin walled, blow molded, polyester container adapted to be filled with a liquid at a temperature elevated above room temperature, said container comprising:

a mouth defining an opening into said container;

a neck including sealing means formed at least partially thereon for receiving a closure cap to seal said container;

a shoulder portion adjacent to said neck and extending generally downward and outward therefrom, said shoulder portion including a upper portion extending downward from said neck and generally increasing to a first diameter proceeding away from said mouth, a lower portion defining a second diameter being greater than said first diameter, and a reduced diameter portion located between and unitarily connecting said upper and lower portions, said reduced diameter portion extending circumferentially around said container and forming a recessed annular groove between said upper and lower portions, said reduced diameter portion having a diameter which is less than said second diameter and greater than that of said first diameter;

at least three substantially upright ribs formed in said reduced diameter portion, said ribs being located such that no two ribs are in a common plane drawn through a longitudinal axis through said container and being hollow and extending longitudinally between said upper portion and said lower portion, said ribs reinforcing said reduced diameter portion increasing the top load capacity of said container, said ribs being equidistantly spaced around said reduced diameter portion and protruding radially outward from said reduced diameter portion;

a side wall of generally tubular shape, said side wall being configured to accommodate a volumetric shrinkage of the liquid as a result of cooling of the liquid; and a bottom portion closing off said side wall and forming a base of said container.

9. A thin walled, blow molded, polyester container as set forth in claim 8 having an odd number of said ribs.

10. A thin walled, blow molded, polyester container as set forth in claim 8 wherein said ribs are generally U-shaped in horizontal cross section.

* * * * *